United States Patent [19]

Hauffe et al.

[11] 4,419,199

[45] Dec. 6, 1983

[54] PROCESS FOR PHOSPHATIZING METALS

[75] Inventors: Dieter Hauffe, Frankfurt; Gerhard Muller, Hanau; Werner Rausch, Oberursel; Gudrun Volling, Frankfurt am Main, all of Fed. Rep. of Germany

[73] Assignee: Occidental Chemical Corporation, Warren, Mich.

[21] Appl. No.: 373,475

[22] Filed: Apr. 30, 1982

[30] Foreign Application Priority Data

May 9, 1981 [DE] Fed. Rep. of Germany ..... 3118375

[51] Int. Cl.[3] ..... C23F 7/10; C23F 7/12; C25D 13/06; C25D 13/20

[52] U.S. Cl. ..... 204/181 R; 204/181 C; 204/181 N; 148/6.15 Z

[58] Field of Search ..... 204/181 N, 181 C, 181 R; 148/6.15 Z

[56] References Cited

U.S. PATENT DOCUMENTS

| | | | |
|---|---|---|---|
| 4,233,087 | 11/1980 | Cooke | 148/6.15 Z |
| 4,265,677 | 5/1981 | Muller et al. | 204/181 C |
| 4,311,535 | 1/1982 | Yasuhara et al. | 204/181 N |

*Primary Examiner*—Howard S. Williams
*Attorney, Agent, or Firm*—Richard P. Mueller

[57] ABSTRACT

A process for the phosphatizing of metals, particularly iron, steel and zinc, in which the metal is contacted with acidic aqueous zinc phosphate solutions, containing an oxidizing agent, which contain from 0.4 to 1.5 g/liter of Zn,
from 0 to 1.3 g/liter of Ni and
from 10 to 26 g/liter of $P_2O_5$, and in which the weight ratio of Zn to $P_2O_5$ is adjusted to a value of (from 0.012 to 0.12):1 and of Ni to Zn to a value of (from 0 to 1.5):1, and the bath is supplemented with a concentrate, in which Zn, Ni and $P_2O_5$ are present in a weight ratio of (from 0.18 to 0.33:(from 0 to 0.06):1, so as to obtain satisfactory phosphatizing results over a long period.

Preferably, the zinc phosphatizing solutions, which, in addition, may also contain simple or complex fluorides and compounds that reduce the weight of the coat, are applied at a temperature within the range of from 30° to 65° C.

6 Claims, No Drawings

PROCESS FOR PHOSPHATIZING METALSThis invention relates to a process for phosphatizing metals and more particulary relates to a process for the treatment of iron, steel, zinc and/or aluminum with an acidic aqueous zinc phosphate solution containing an oxidizing agent to form a phosphate coating thereon which is particularly suitable as a base for the subsequent application of an electrophoretic coating.

BACKGROUND OF THE INVENTION

In West German Offenlegungsschrift 22 32 067, there is described an aqueous acidic phosphatizing solution having a weight ratio of Zn: $PO_4$ of 1:12 to 110 or, expressed as Zn: $P_2O_5$ of 0.11 to 0.012:1, for the treatment of meatl surfaces, particularly iron and steel. The lower zinc content of this bath, as compared to conventional phosphatizing baths, results in improved, thin and uniform phosphate coatings which exhibit good adhesion and stability and which are particularly suitable as a base for the application of a subsequent electrophoretic coating.

Additionally, a process for phosphatizing metals which are then subsequently electroplated is described in West German Offenlegungsschrift 30 04 927. In this process, an aqueous acidic solution is used which contains from about 0.5 to 1.5 g/l of zinc and from about 5 to 30 g/l of phosphate and further contains a nitrite and/or an aromatic nitro-compound. The surfaces to be treated are first immersed in this phosphatizing solution and are then subsequently sprayed with it.

Similarly, in West German Offenlegungsschrift 25 38 347, there is described an acidic aqueous phosphatizing solution which contains at least 0.5% of phosphate ions and at least 0.03% of zinc. In this solution, the molecular weight ratio of phosphate ions to nitrate ions is about 1:0.7 to 1.3 and the molecular weight ratio of zinc ions to phosphate ions is less than about 0.116:1 or, expressed as a weight ratio of zinc ions:$P_2O_5$ of less than about 0.107:1.

It has been found that during the operation of the above-described processes, high quality phosphate coatings are formed during the initial stages of operation of the process. As the operation of the process is continued, however, with an increase in the total metal throughput, the phosphatizing results begin to fluctuate and become nonuniform. In some instances, for example, although the phosphate coatings retain their uniform appearance, there is an appreciable loss in the quality of the phosphate coating, particularly with regard to its anti-corrosion protection when used in combination with a subsequently applied paint or similarly organic coating. In other instances, deterioration in the appearance of the coating is also observed. Instead of uniformly gray coatings, irridescent passivating coatings and/or slimy deposits are formed.

It is, therefore, an object of the present invention to provide an improved process that overcomes these deficiencies of the known prior art processes.

A further object of the present invention is to provide an improved phosphatizing process which consistently produces a uniform phosphate coating, having very good corrosion resistance, even with large total metal throughput in the phosphatizing bath.

These and other objects will become apparent to those skilled in the art from the description of the invention which follows.

SUMMARY OF THE INVENTION

In accordance with the process of the present invention, the metal surfaces to be treated are brought into contact with an aqueous acidic zinc phosphate solution containing an oxidizing agent and which contains from about 0.4 to 1.5 g/l of zinc, from about 0 to 1.3 g/l of nickel and from about 10 to 26 g/l of $P_2O_5$. In this solution, the weight ratio of Zn:$P_2O_5$ is from about 0.012 to 0.12:1 and the weight ratio of Ni:Zn is from about 0 to 1.5:1. During the operation of the process, the bath content and ratios of these components are maintained by replenishing tha baths with an aqueous acidic replenishing solution containing Zn, Ni and $P_2O_5$ in a weight ratio of from about 0.18 to 0.33:0 to 0.06:1. In this manner, by utilizing a replenishing solution in which the weight ratios of Zn:Ni:$P_2O_5$ are significantly different than the ratios in the operating phophatizing baths as originally formulated, satisfactory phosphatizing results are obtained over extended periods of operation. The present process, operated in this manner, is particularly suitable for the treatment of iron, steel and zinc, but is further suitable for forming phosphate coatings on aluminum surfaces.

DETAILED DESCRIPTION OF THE INVENTION

More specifically, in the practice of the present invention, the initial working phosphate solution and its replenishing solution, containing an oxidizing agent and the components in the amounts and weight ratios as have been set forth hereinabove, are formulated in the conventional manner, using any suitable bath soluble compounds. Although, as has been indicated, the presence of nickel in the working and replenishing solutions is not essential, its addition has been found to have a particularly favorable effect where zinc surfaces are treated. Additionally, improvements in the quality of the phosphate coating formed are also frequently obtained in the treatment of steel surfaces.

In addition to the zinc and nickel, the working and replenishing solutions may also contain other cations such as calcium, copper, manganese, cobalt, and magnesium. When these cations are present, their concentrations in the solutions are typically not in excess of about 0.5 g/l. Generally, it is desirable to maintain the concentration of bivalent iron in the bath at relatively low levels, for example not in excess of about 50 to 100 mg/l. This is accomplished by means of the oxidizing agents which will oxidize the iron (II) to iron (III), which are included in the solutions. In many instances, the bath is substantially free of bivalent iron. Generally, however, the bath will contain iron (III), typically in amounts of about 3 to 40 mg/l, depending upon the particular composition of the working and replenishing solutions. In addition to the foregoing cations, the solution will also generally contain cations of the alkali metal and ammonium group.

As has been noted, the working bath solutions and replenishing solutions will also contain one or more oxidizing agents which, as indicated hereinabove, are capable of oxidizing bivalent iron to the trivalent state. Exemplary of such oxidizing agents and the particular amounts in which they may be present in the solutions are the following: 2 to 25 g/l $NO_3$; 1 to 6 g/l $ClO_3$; 0.1 to 2 g/l of an organic nitro-compound, such as sodium m-nitrobenzene sulphonate; 0.05 to 0.5 g/l of an alkali metal nitrite; and 0.02 to 0.1 g/l of $H_2O_2$.

Where the process of the present invention is utilized for the treatment of zinc and/or aluminum surfaces, it is also preferred to include in the working and replenishing solutions a simple and/or complex fluoride, as are well known in the art, to improve the formation of the coating layer. In many instances, these components may also be included in the treatments of iron and steel to which the similar layer formation improvement.

Finally, in the many instances, it is also preferred to include in the working and replenishing solutions, components, as are known in the art, for the reduction in the weight of the phosphate coating produced. Typical of such compounds are the hydroxycarboxylic acids, such are tartaric acid, citric acid, and the like, and the polyphosphates, such as the tripolyphosphates and the hexametaphosphates.

The specific amounts and ratios, within the ranges which have been set forth hereinabove, of the foregoing cations and anions will be determined, as is well known in the art, for each particular coating operation. In general, these cations and anions will be present in a quantitative ratio such that the acidity of the bath is at or near the phosphatizing equilibrium.

In the operation of the process of the present invention, the treatment of the metal surfaces may be effective by any suitable technique, including spraying, flow coating, and immersion. Additionally, combined methods of application, such as spraying-immersion-spraying, spraying-immersion, immersion-spraying, and the like, may also be used. The contact time of the phosphatizing solution with metal surface will be within the range of times customary for the particular contacting procedure used. Typically, for spray contact, these will be from about 75 seconds to 3 minutes; from about 2 to 5 minutes for immersion processes; and about 20 seconds spraying and 3 minutes immersion for a combined spray-immersion process. Typically, in these operations, the bath temperature will be within the range of about 30 to 65° C.

The initial working bath solutions will be formulated with the component amounts and weight ratios as have been set forth hereinabove. Thereafter, during the use of these solutions, they will be replenished with the replenishing solution having the specified weight ratio of components indicated above as is necessary to maintain the amounts and ratios of the bath components at the desired operating levels. Typically the phosphate coatings produced by the process of the present invention will have coating weights within the range of about 0.8 to 5 g/m$^2$. Where it is desired to produce particularly thin, finely crystalline phosphate layers, an activator, such as those based on titanium phosphate, may be applied in a prerinsing bath or in the final cleaning step prior to application of the phosphate coating solutions.

The phosphate coatings produced by the present process are suitable for all types of applications of phosphate coatings are presently known. When these coatings are used in combination with a coating of paint or similar organic material, the phosphate coating provides a marked improvement in the resistance of the paint film to substrate migration, in the case of exposure to corrosion and further provides a significant increase in the adhesion of the paint to the metallic substrate. Such improvements are particularly noticeable where the paint coating is an electrophoretic coating, especially a cathodic electrophoretic coating. The present process is, therefore, particularly useful as a base for coatings of this type and finds practical application in the phosphatizing of auomobile bodies prior to the application of such electrophoretic paint coatings.

SPECIFIC EXAMPLES

In order that those skilled in the art may be better understand the present invention and the manner in which it may be practiced, the following specific examples are given. In these examples, sheets of steel, galvanized steel, and aluminum were degreased with a mildly alkaline titanium phosphate containing activating detergent. The sheets were then treated with the bath solutions as described in the following table, which bath solutions were periodically replenished during the treatment using the supplement concentrate solutions indicated. In this table, Examples 1 to 4 are illustrative of the process of the present invention. Example 5, however, is a comparative example in which the replenishment of the operating bath is effected with a concentrate in which the ratio of Zn:Ni:$_2O_5$ is approximately the same as the ratio of these components in the working bath.

EXAMPLES

| | 1 | 2 | 3 | 4 | 5 |
|---|---|---|---|---|---|
| bath solution | | | | | |
| Zn (g/l) | 0.8 | 1.0 | 1.5 | 1.0 | 0.8 |
| Ni (g/l) | 0.5 | 1.0 | 1.0 | 1.0 | 0.5 |
| $P_2O_5$ (g/l) | 14.1 | 15 | 15 | 15.1 | 14.1 |
| $ClO_3$ (g/l) | 1.5 | — | — | 2.8 | 1.5 |
| $NO_2$ (g/l) | 0.08 | 0.1 | 0.12 | — | 0.08 |
| $NO_3$ (g/l) | 2.0 | 2.1 | 2.1 | 2.2 | 2.0 |
| Zn:$P_2O_5$ | 0.056:1 | 0.067:1 | 0.1:1 | 0.067:1 | 0.056:1 |
| Ni:Zn | 0.625:1 | 1:1 | 0.67:1 | 1:1 | 0.625:1 |
| free acid* | 0.9 | 1.7 | 1.7 | 0.7 | 0.9 |
| total acid** | 22.5 | 26 | 27 | 22.5 | 22.5 |
| bath temperature (°C.) | 52 | 60 | 52 | 54 | 52 |
| treatment time (min.) | 2 | 2 | 0.3/3 | 2 | 2 |
| application*** | spr. | spr. | spr./ta. | spr. | spr. |
| supplement concentrate | | | | | |
| Zn (%) | 7.59 | 6.67 | 9.2 | 7.21 | 1.66 |
| Ni (%) | 0.58 | 0.87 | 0.656 | 1.04 | 1.04 |
| $P_2O_5$ (%) | 29.2 | 29.0 | 32.8 | 26.0 | 29.2 |
| Na (%) | 1.78 | 2.07 | 0.447 | 1.88 | 5.32 |
| $NO_3$ (%) | — | 1.84 | 1.39 | 2.2 | — |

EXAMPLES-continued

| | 1 | 2 | 3 | 4 | 5 |
|---|---|---|---|---|---|
| $ClO_3$ (%) | 2.48 | — | — | 3.82 | 2.48 |
| $Zn:Ni:P_2O_5$ | 0.26:0.02:1 | 0.23:0.03:1 | 0.28:0.02:1 | 0.28:0.04:1 | 0.057:0.036:1 |

*number of ml N/10 NaOH for 10 ml of bath sample against dimethyl yellow
**number of ml N/10 NaOH for 10 ml of bath sample against phenolphthalein
***spr = spraying; ta = dipping With the operation of the process in accordance with Examples 1 to 4, the desired components and ratios of the bath component were maintained for extended periods of time with completely satisfactory phosphate coatings being produced in all cases. In those baths which contained nitrite, it was also necessary to supplementally replenish the nitrite accelerator in the well known conventional manner. Additionally in the bath of Example 4, periodic additions of caustic soda solutions were also required in order to maintain the free acid level in this bath at the predetermined value.

In contrast, in the operation of Example 5, after a throughput of metal which was less than 0.5 $m^2/l$ of bath solution, it was no longer possible to develop satisfactory coatings by replenishing the bath with the supplement concentrate indicated. After this throughput of metal, the coatings formed were irridescent passivating coatings having partly slimy deposits.

EXAMPLE 6

Sheets of steel, galvanized steel and aluminum are treated in accordance with the procedure set forth in the foregoing Examples 1 through 4. Thereafter, the thus-phosphate coated sheets are painted with a conventional cathodic electrophoretic paint and the thus-painted sheets are subjected to corrosion and adhesion tests. In each instance, excellent corosion resistance and adhesion of the paint film to the substrate are obtained.

What is claimed is:

1. A process for phosphatizing metal surfaces which comprises forming a phosphate coating on the metal surface by contacting the metal surface with an aqueous acidic zinc phosphate solution containing an oxidizing agent, which zinc phosphate solution contains:

from about 0.4 to 1.5 g/liter of Zn,
from 0 to 1.3 g/liter of Ni and
from 10 to 26 g/liter of $P_2O_5$, and in which the weight ratio of Zn to:$P_2O_5$ is from about 0.012 to 0.12:1 and the weight ratio of Ni to Zn is from about 0 to 1.5:1 and, thereafter, replenishing the said zinc phosphate solution with a replenishing solution in which the weight ratio of $Zn:Ni:P_2O_5$ is from about 0.18 to 0.33:0 to 0.06:1.

2. The process as claimed in claim 1 in which the oxidizing agent is selected from and is present in the amount of:

2 to 25 g/liter of $NO_3$;
1 to 6 g/liter of $ClO_3$;
0.1 to 2 g/liter of an organic nitro-compound;
0.05 to 0.5 g/liter of $NO_2$; and
0.02 to 0.1 g/liter of $H_2O_2$.

3. The process as claimed in claim 2 in which the zinc phosphate solutions used also contain at least one of a simple fluoride or a complex fluoride.

4. The process as claimed in claim 2 in which the zinc phosphate solutions used also contain at least one coating weight reducing compound selected from hydroxycarboxylic acids and polyphosphates.

5. The process as claimed in claim 1 in which the zinc phosphate solutions used are at a temperature within the range of about 30° to 65° C.

6. The process as claimed in claim 1, 2, 5, 3, or 4 in which, following the formation of the phosphate coating on the metal surfaces treated, an electrophoretic coating is applied to said treated surfaces.

* * * * *